US012345492B2

(12) United States Patent
Piche et al.

(10) Patent No.: US 12,345,492 B2
(45) Date of Patent: Jul. 1, 2025

(54) HYBRID HETEROGENEOUS MATERIAL BAFFLE FOR FIREARM NOISE SUPPRESSOR

(71) Applicant: Summit Sound Technologies LLC, Austin, TX (US)

(72) Inventors: Stephen A. Piche, Taunton, MA (US); Karl R. Edminster, Fairhaven, MA (US)

(73) Assignee: Summit Sound Technologies LLC, Austin, TX (US)

( * ) Notice: Subject to any disclaimer, the term of this patent is extended or adjusted under 35 U.S.C. 154(b) by 33 days.

(21) Appl. No.: 18/457,831

(22) Filed: Aug. 29, 2023

(65) Prior Publication Data

US 2024/0068763 A1 Feb. 29, 2024

Related U.S. Application Data

(60) Provisional application No. 63/373,780, filed on Aug. 29, 2022.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4
See application file for complete search history.

(56) References Cited

U.S. PATENT DOCUMENTS

| | | | | |
|---|---|---|---|---|
| 5,679,916 | A | 10/1997 | Weichert | |
| 6,308,609 | B1 | 10/2001 | Davies | |
| 8,087,338 | B1 | 1/2012 | Hines | |
| 9,702,651 | B2 | 7/2017 | Petersen | |
| 9,851,166 | B2 | 12/2017 | Petersen | |
| 10,054,382 | B2 * | 8/2018 | Palu | F41A 21/30 |
| 11,486,669 | B2 * | 11/2022 | Bowers | F41A 21/30 |
| 11,561,059 | B2 * | 1/2023 | Reis-Green | F41A 21/30 |
| 2010/0116200 | A1 | 5/2010 | Takahashi | |
| 2015/0041246 | A1 * | 2/2015 | Coley | F41A 21/30 181/264 |
| 2016/0084602 | A1 * | 3/2016 | Smith | F41A 21/325 89/14.05 |
| 2017/0038172 | A1 * | 2/2017 | Palu | F41A 21/30 |
| 2017/0160034 | A1 * | 6/2017 | Parker | F41A 21/30 |
| 2019/0339036 | A1 * | 11/2019 | Edminster | F41A 21/30 |
| 2022/0260332 | A1 * | 8/2022 | Grob | F41A 21/30 |

FOREIGN PATENT DOCUMENTS

WO WO-2023137270 A9 * 12/2023

* cited by examiner

*Primary Examiner* — Samir Abdosh
(74) *Attorney, Agent, or Firm* — Wood Herron & Evans LLP

(57) ABSTRACT

Provided is a firearm noise suppressor baffle formed of at least two material zones. The zones are made of materials having dissimilar coefficients of thermal expansion from each other and have an interface substantially transverse to a bore axis. The baffle includes an annularly interrupting gap having a width. The gap is formed in at least one of the material zones and extends substantially longitudinal relative to the bore axis from an edge of the baffle.

10 Claims, 8 Drawing Sheets

HYBRID HETEROGENEOUS MATERIAL BAFFLE FOR FIREARM NOISE SUPPRESSOR

RELATED APPLICATION

This application is a U.S. Nonprovisional patent application claiming priority to U.S. Provisional Patent Application No. 63/373,780, filed Aug. 29, 2022, the entirety of which is incorporated by reference herein.

TECHNICAL FIELD

This invention relates to the construction and materials for baffles used in firearm noise suppressors (silencers). In particular, it relates to overcoming problems encountered when forming a unitary baffle structure from a combination of different materials.

BACKGROUND

The function and general structure of a firearm noise suppressor is well-known to those of ordinary skill in the art. They generally include a housing that is divided into multiple internal chambers by axially spaced-apart internal walls known as baffles. Many baffle shapes have been tried and used, but all generally include a through passageway aligned with the axis if the firearm bore sized to allow the projectile (bullet) to pass without contact with the baffle, but to otherwise restrict the flow of high pressure, high velocity, high temperature gasses that propel the projectile.

It is desirable to use different materials at different locations in the structure of a baffle or other silencer component to maximize the efficiency of that composite structure by locating materials such that their particular properties offer the best performance at a particular location. As an example, the outer wall of a silencer structure must contain high pressure gasses at elevated temperatures. At this location within the structure it is desirable to have a material with high tensile strength and toughness. For a baffle with a conical shape it is desirable to have high tensile and compressive strength and stiffness to resist buckling when subjected to the impulse pressure loading of the expanding muzzle gasses. In the area immediately adjacent the bore aperture it is desirable to have materials with resistance to hot gas and particle erosion at elevated temperatures. Conventional processes have historically been to use a single material for the entire baffle, machined or formed from bar or sheet stock. A baffle designed in this way requires compromises to be made including the addition of material to strengthen the baffle and provide extra material to resist hot gas erosion.

Others have used grommet-like inserts of erosion resistant material sometimes swaged into place at the critical location. But problems are encountered if the unlike materials that will be subjected to extreme temperature fluctuations are fused together. Because the materials expand and contract at different rates, welds are compromised or one of the materials will be forced to warp, risking catastrophic failure.

SUMMARY OF THE INVENTION

This invention describes a baffle or silencer element where that component is manufactured either by conventional or additive manufacturing processes. These processes would allow a baffle or silencer structure to be heterogeneous in composition including two or more materials.

These materials could include metals such as steels, maraging steels, nickel/cobalt superalloys, other metallic alloys, carbides and carbide matrices, ceramics, polymers, glasses or other materials.

In one implementation an additive manufacturing process (for example, DMLS, binderjet or other) would create one part of a baffle or silencer structure. During the manufacturing process the material would be changed to continue the build process with a different material. The dissimilar materials would be joined during the process at a single plane. The joinder may be a permanent fusion of the materials.

The present invention provides structurally different compositions of material with different metallurgical properties in combination to form a suppressor baffle. Specifically, at least the second material is annularly segmented with at least one interruption to allow thermal expansion of the adjacent dissimilar materials at different rates while reducing the stress concentration at the interface plane. It may be desirable for the annular slot, interruption or discontinuity to pass through one, both or all adjacent materials.

It is known to use baffles made from one material with a tube or other component made from a different material. It is also known to use a "stack" of components (such as a blast chamber, blast baffle, and other baffles) that may be of different materials. This invention specifically addresses where dissimilar materials are integrally fused without separation that can result from manufacturing tolerances, etc., such as a hybrid baffle with dissimilar materials close to the bore aperture.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
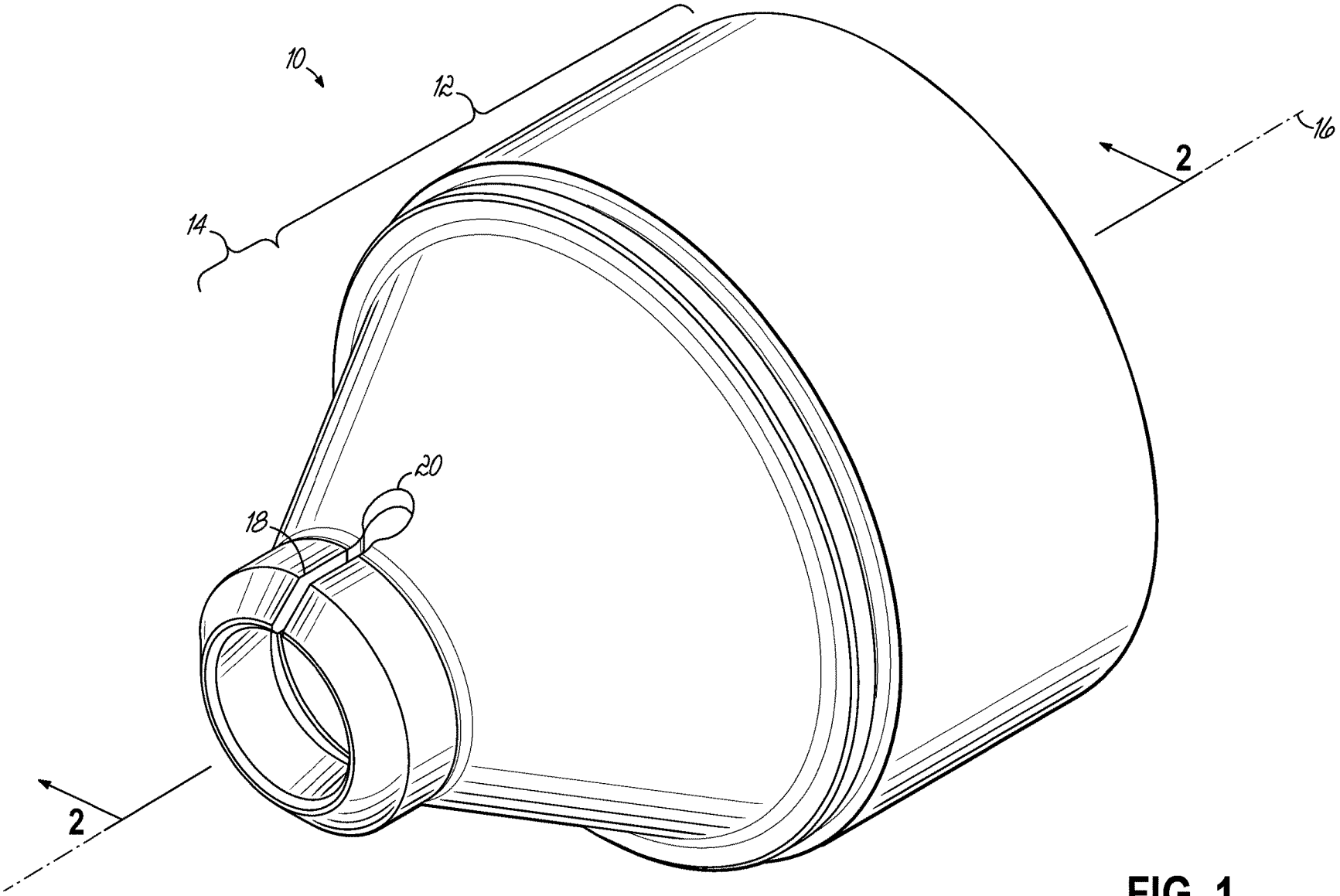
FIG. 1 is an isometric view of a firearm noise suppressor baffle according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel and projectile path. Although firearms may be used in any orientation, "left" and "right" will generally indicate the sides according to the user's orientation, "top" or "up" will be the upward direction when the firearm is gripped in the ordinary manner, although a suppressor typically has no identified axial orientation.

Suppressors dissipate the energy of the propellant blast in multiple ways, including by extending the period of time over which the high pressure is released to the atmosphere, by creating internal turbulence that consumes kinetic energy, and by adsorbing heat. Adsorbed heat will cause the materials of the suppressor to expand according to the materials' coefficient of thermal expansion (CTE). When a suppressor or suppressor component is made of a single material, its thermal expansion is substantially uniform in all directions according to CTE. But if a suppressor baffle, for example, is made of heterogenous materials having dissimilar CTEs that are fused together rather than assembled in a way that allows sheer movement at the interface between materials, stresses induced by the nonuniform expansion/contraction at the interface(s) between materials can cause cracking, separation, warping, or other potentially catastrophic failure.

The present invention provides a way to form a suppressor part, such as a baffle, from two or more discrete, dissimilar materials that are permanently bonded/fused together. Multiple materials/layers may be used to locate materials where their properties can more efficiently be used. For example, cobalt or nickel based high temperature alloys can be used for leading edges and bore aperture structures to resist hot gas erosion and maraging steel (steels that are known for possessing superior strength and toughness without losing ductility) or other high strength alloys used for baffle and tube walls. The thicknesses and relative proportions of the different materials represent distinctive structural material and not just the coating or cladding of an underlying structure.

Transitions between materials can be formed, for example, along a single plane and that plane can be normal to the central bore axis of the baffle or suppressor. The dissimilar materials are permanently bonded along that plane. For additive manufacturing (3D printing), direct sintering can be used for DMLS and bonding during the post print heat treat process can be used for binderjet and similar processes. The bonded/welded/fused materials may be directly joined or may include additional transition layers comprised of different materials Transition materials may provide for bonding of materials that cannot be bonded directly such as metalized coatings on ceramics/carbides. Transition materials may have increased elasticity to distribute stresses that occur between the layers Transition layers may prevent or at least minimize dilution or weld puddle/melt zone alloy mixing to preserve properties of the joined materials or prevent the unintentional weaking of the joint by formation of weak/brittle mixed alloys melt zone.

Another implementation may be where a machined or otherwise conventionally manufactured element is joined to an additively manufactured element to accomplish this hybrid structure others have inserted elements and encapsulated them by an additive process. In contrast, according to this invention, elements could be formed by using an intermediate "bond" layer, such as a high temperature brazing material. After printing, a secondary heat treatment could melt the brazing material to permanently bond the materials/structures.

According to a feature of the present invention, leading edge/bore aperture liner structure may be annularly discontinuous. The discontinuity of the "ring" is created where a slot/notch in the baffle is formed. This "break" provides a stress relief between the dissimilar materials that have dissimilar CTEs. Failure to provide this stress relief can induce high stresses at the joint between the materials, leading to the formation of cracks. The discontinuous ring for stress reduction applies to both conventionally machined parts that are welded together and additively manufactured parts that are joined to conventionally machined or other additively manufactured parts.

Figure 2:
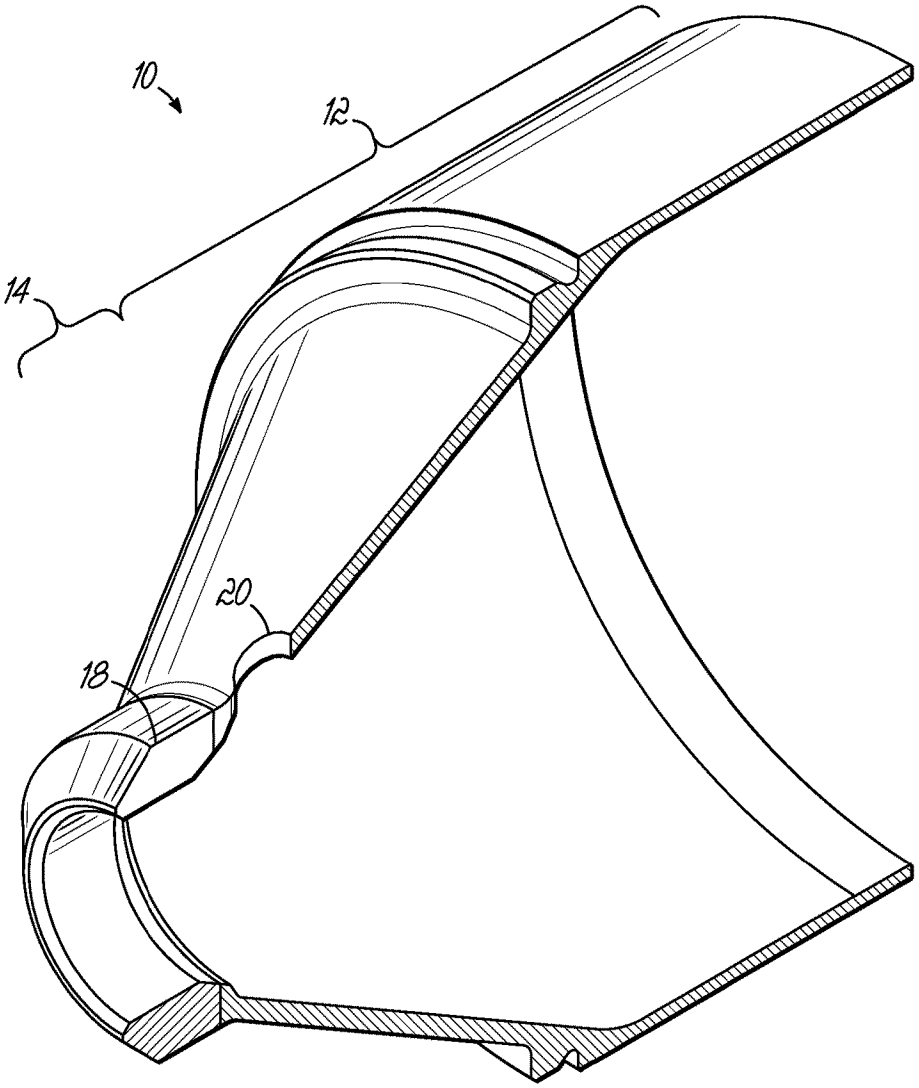
FIG. 2 is an isometric sectional view taken substantially along line 2-2 of FIG. 1.
Figure 3:
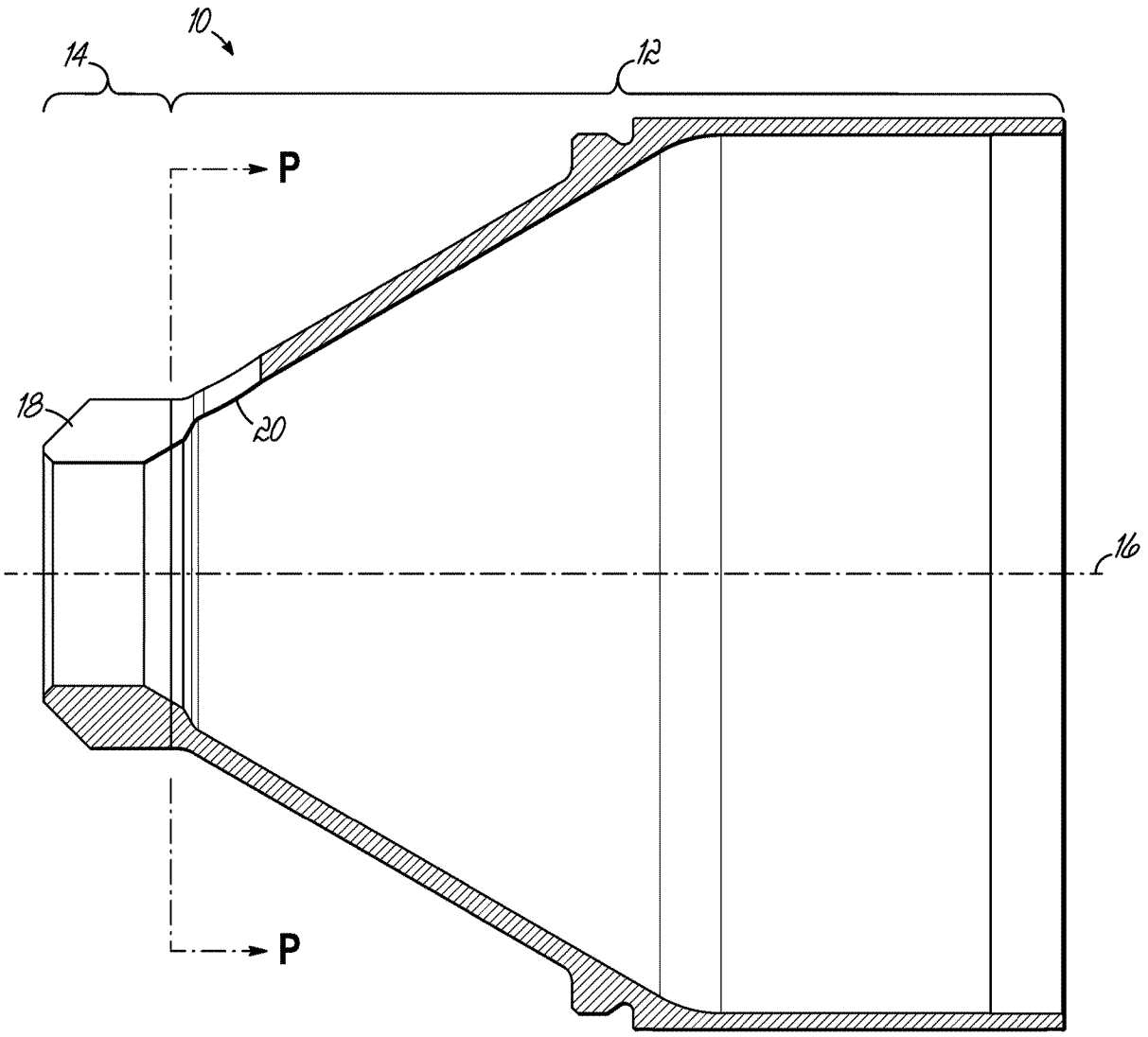
FIG. 3 is a side sectional view also taken substantially along line 2-2 of FIG. 2.
Figure 4:
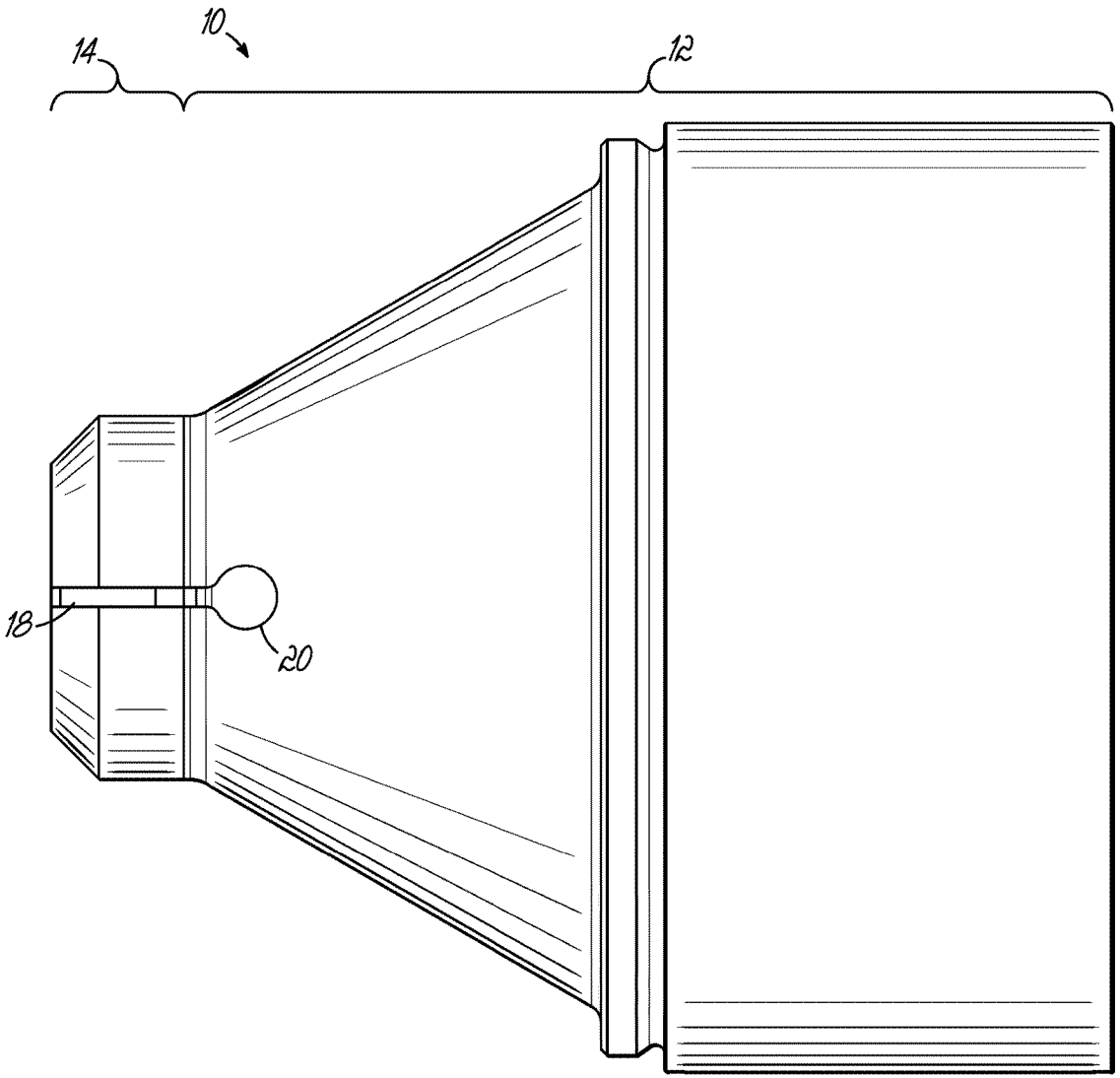
FIG. 4 is a top plan view thereof.

A person of ordinary skill in the art of forearm noise suppressors is assumed to understand how internal baffles are assembled to form a series of internal chambers. Referring first to FIGS. 1-4, therein is shown an example firearm noise suppressor baffle 10 with a first portion 12 made of a first material and a second portion 14 made of a second material according to an embodiment of the present invention. In this example, the interface between dissimilar materials is formed substantially along a single plane P substantially normal to the central bore axis 16. A slot 18 is created (either as mart of the manufacturing process or after the heterogeneous material baffle part has been formed) that annularly interrupts at least the second portion 14. In the illustrated embodiment, the break 18 also extends partially into the first portion 12 and may terminate with a crack-stopping feature 20. The discontinuity may be of minimal width so as not to significantly affect the flow of gases, but to allow thermal expansion/contraction without creating shear forces at the interface P between materials.

Turbulence can be created within a suppressor body in many ways, one of which is to create cross currents where the high pressure gas flow passes through the constricted bore aperture between expansion chambers. This can be done, for example, by making the aperture asymmetrical with a "mouse hole" effect that extends partially into the conical part of the baffle. In this manner, both the first and second material portions are annularly discontinuous in at least one area.

Figure 5:
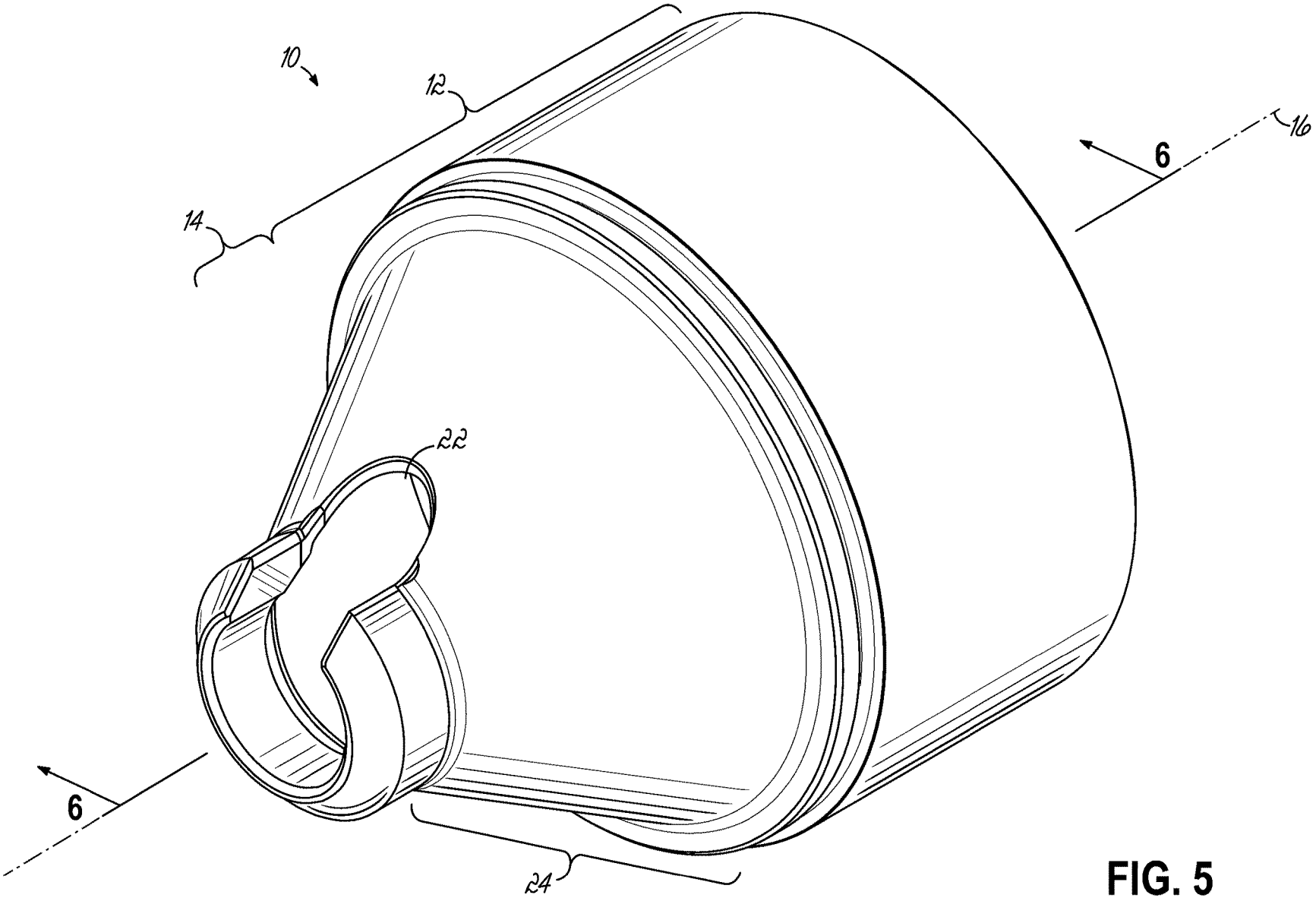
FIG. 5 is an isometric view of a firearm noise suppressor baffle according to another embodiment of the present invention
Figure 6:
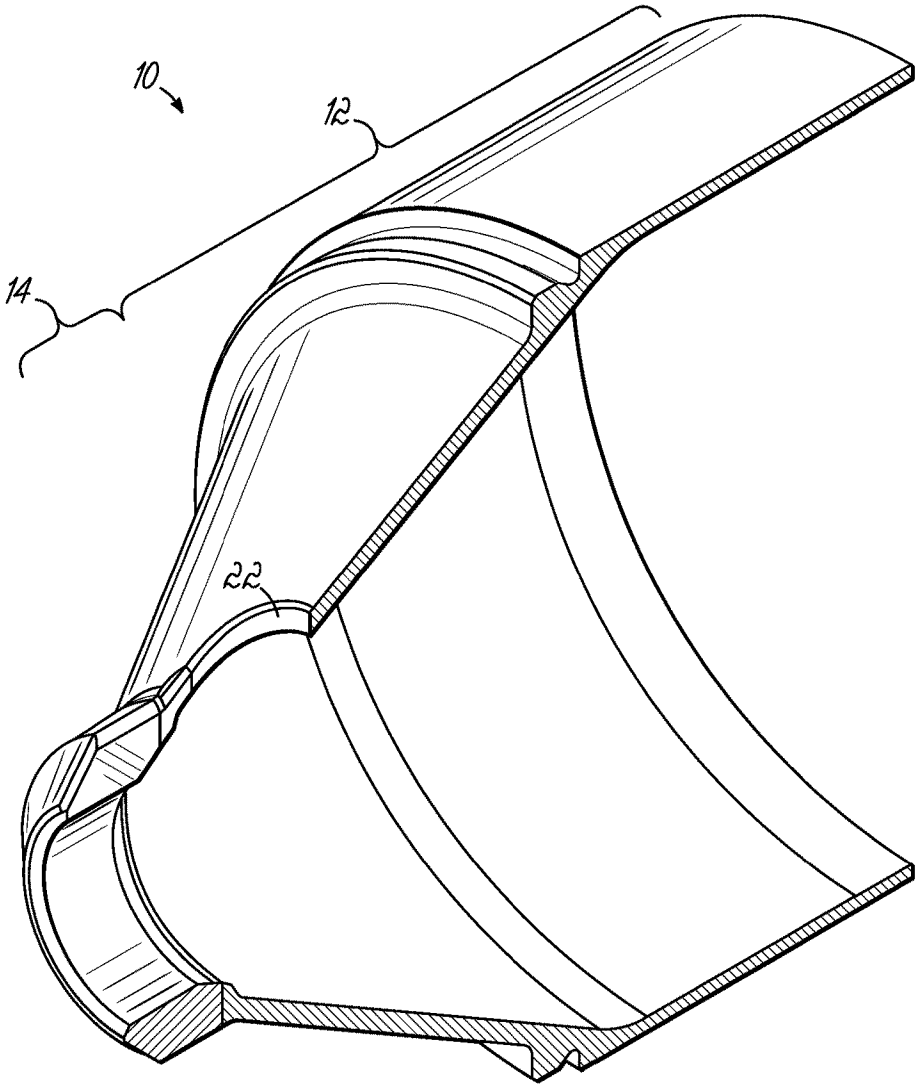
FIG. 6 is an isometric sectional view taken substantially along line 6-6 of FIG. 5.
Figure 7:
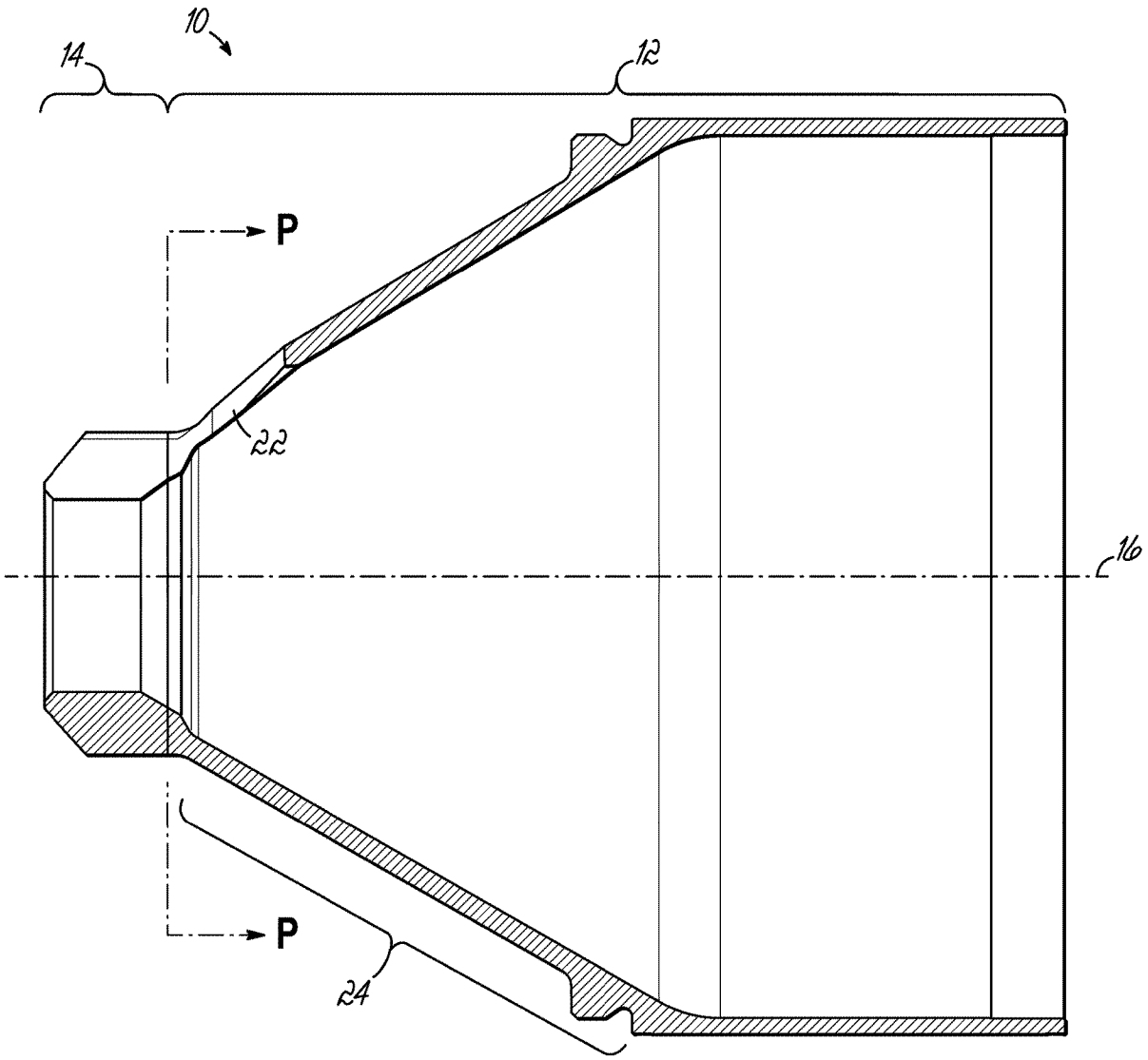
FIG. 7 is a side sectional view also taken substantially along line 6-6 of FIG. 5.
Figure 8:
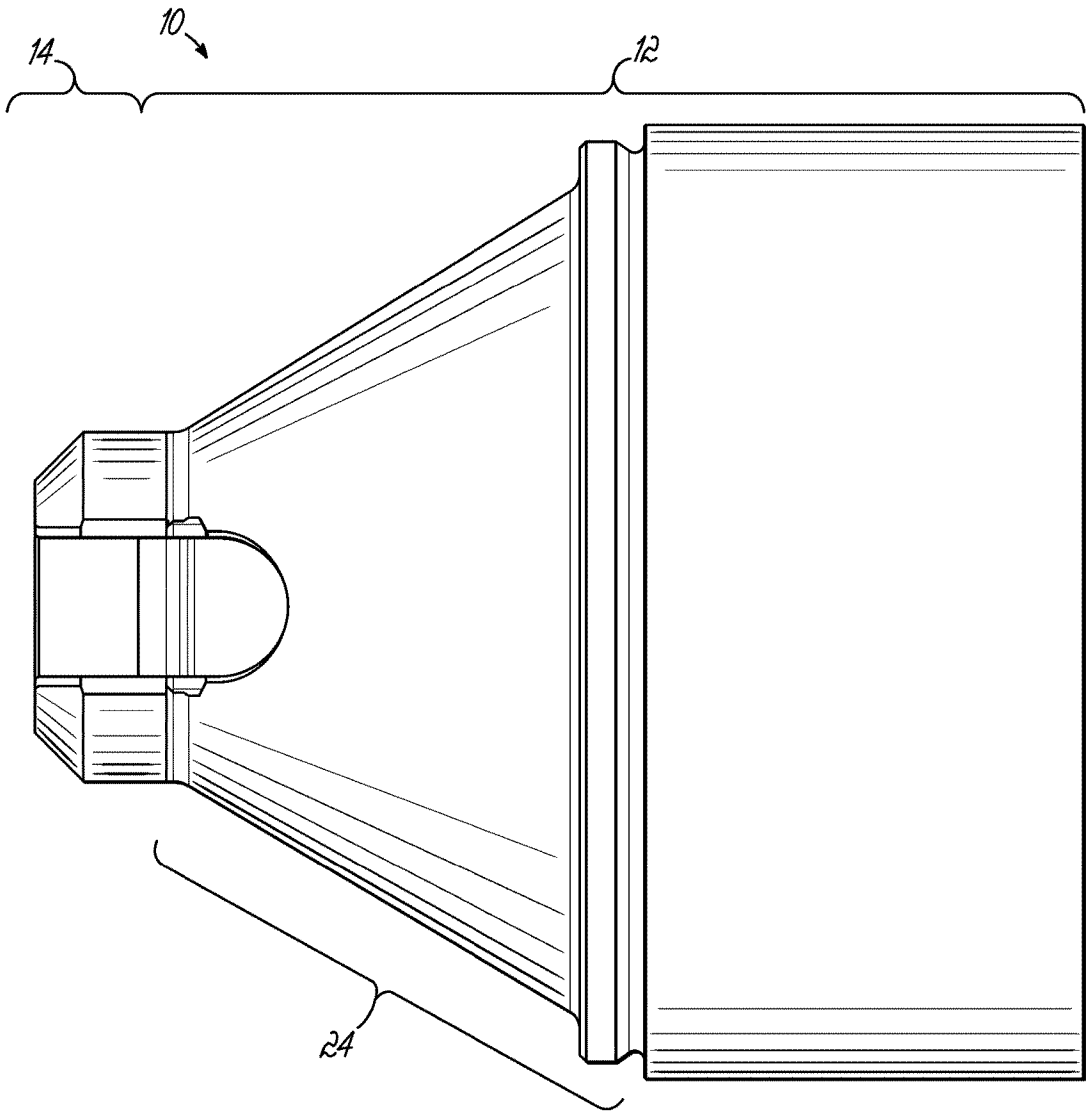
FIG. 8 is a top plan view thereof.

As illustrated, for example, in FIGS. 5-8, an asymmetric cut extending into the conical wall portion 24 may be of significant width to create turbulence and/or a disruptive cross flow of the high, pressure, high, velocity gas stream according to known principles.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A firearm noise suppressor baffle having a substantially conical portion with a narrowed end and a projectile passageway at the narrow end, the conical portion being formed of at least two material zones, the material zones being made of materials having dissimilar coefficients of thermal expansion from each other with an interface substantially transverse to a bore axis that integrally fuses the material zones together, the baffle including an annularly interrupting gap having a width, the gap formed in at least one of the material zones and extending substantially longitudinal relative to the bore axis from an edge of the baffle.

2. A firearm noise suppressor baffle formed of at least two material zones, the zones being made of materials having dissimilar coefficients of thermal expansion from each other with an interface substantially transverse to a bore axis, the baffle including an annularly interrupting gap having a width, the gap formed in at least one of the material zones and extending substantially longitudinal relative to the bore axis from an edge of the baffle, wherein the gap extends into at least two material zones.

3. The baffle of claim 1, wherein the gap has an end portion distal to the edge that is enlarged larger in width relative to the width of the gap.

4. The baffle of claim 1, wherein the gap has an end portion distal to the edge that is rounded and similar in width to that of the gap.

5. A firearm noise suppressor baffle formed of at least two material zones, the zones being made of materials having dissimilar coefficients of thermal expansion from each other with an interface substantially transverse to a bore axis, the baffle including an annularly interrupting gap having a width, the gap formed in at least one of the material zones and extending substantially longitudinal relative to the bore axis from an edge of the baffle and wherein a first one of the materials is positioned at the narrowed end and the remainder of baffle is made of at least a second one of the materials.

6. The baffle of claim 5, wherein the material zone at the conical narrow end has erosion resistant properties.

7. The baffle of claim 1, wherein the gap extends from an edge at the narrowed end.

8. The baffle of claim 7, wherein the gap extends into a plurality of material zones.

9. The baffle of claim 8, wherein the gap has an end portion distal to the edge that is enlarged larger in width relative to the width of the gap.

10. The baffle of claim 8, wherein the gap has an end portion distal to the edge that is rounded and similar in width to that of the gap.

* * * * *